US007329979B2

(12) United States Patent
Bewlay et al.

(10) Patent No.: US 7,329,979 B2
(45) Date of Patent: Feb. 12, 2008

(54) ELECTRICALLY CONDUCTIVE CERMET AND DEVICES MADE THEREOF

(75) Inventors: Bernard Patrick Bewlay, Schenectady, NY (US); Bruce Alan Knudsen, Amsterdam, NY (US); James Anthony Brewer, Scotia, NY (US); James Scott Vartuli, Rexford, NY (US); Dennis Joseph Dalpe, Schenectady, NY (US); Mohamed Rahmane, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 490 days.

(21) Appl. No.: 10/891,275

(22) Filed: Jul. 15, 2004

(65) Prior Publication Data

US 2006/0012306 A1 Jan. 19, 2006

(51) Int. Cl.
*H01J 5/48* (2006.01)
*H01J 5/50* (2006.01)

(52) U.S. Cl. ..... 313/318.01; 313/493; 313/623; 313/634; 428/325

(58) Field of Classification Search ..... 313/493, 313/623, 634, 636, 318.01; 428/325

See application file for complete search history.

(56) References Cited

U.S. PATENT DOCUMENTS

| | | | | |
|---|---|---|---|---|
| 4,155,758 | A * | 5/1979 | Evans et al. | 75/232 |
| 4,316,936 | A * | 2/1982 | Hing | 428/325 |
| 4,354,964 | A | 10/1982 | Hing et al. | |
| 4,501,799 | A * | 2/1985 | Driessen et al. | 428/446 |
| 4,563,214 | A | 1/1986 | Seddon et al. | |
| 4,602,956 | A | 7/1986 | Partlow et al. | |
| 4,808,882 | A * | 2/1989 | Parker et al. | 313/625 |
| 4,825,126 | A * | 4/1989 | Izumiya et al. | 313/623 |
| 5,460,640 | A | 10/1995 | Buljan et al. | |

FOREIGN PATENT DOCUMENTS

| | | |
|---|---|---|
| GB | 1571084 | 7/1980 |
| JP | 06168704 | 6/1994 |

OTHER PUBLICATIONS

PCT Search Report.

* cited by examiner

*Primary Examiner*—Nimeshkumar D. Patel
*Assistant Examiner*—Kevin Quarterman
(74) *Attorney, Agent, or Firm*—Jason K. Klindtworth; Curtis B. Brueske

(57) ABSTRACT

An electrically conducting cermet comprises at least one transition metal element dispersed in a matrix of at least one refractory oxide selected from the group consisting of yttria, alumina, garnet, magnesium aluminum oxide, and combinations; wherein an amount of the at least one transition metal element is less than 15 volume percent of the total volume of the cermet. A device comprises the aforementioned electrically conducting cermet.

27 Claims, 4 Drawing Sheets

ELECTRICALLY CONDUCTIVE CERMET AND DEVICES MADE THEREOF

BACKGROUND OF THE INVENTION

The present invention generally relates to electrically conductive cermet materials. More particularly, the invention relates to electrically conducting cermet materials suitable for use in end caps for high intensity lamp applications.

High intensity discharge lamps are required to run at high temperatures and high pressures in order to raise the color rendering effect of the lamp and to improve the efficiency of the lamp. Because of operational limitations, various parts of these lamps are made of different types of materials. Bonding of dissimilar materials in high temperature lamps poses numerous challenges such as thermal stresses and cracks that develop because of thermo-mechanical stresses resulting from a mismatch in the thermal coefficients of expansion of the adjoining parts. Ideally, all the materials used in such lamps should have the same coefficient of thermal expansion. If these materials have substantially different coefficients of thermal expansion, at elevated temperatures, stresses develop as the different materials expand at different rates. Articles that are well designed, however, can tolerate some differences in coefficients of thermal expansion.

The components of a high intensity discharge lamp assembly include ceramic envelope, electrodes, end caps, and wire feedthrough conductors. Usually, a ceramic envelope for high intensity lamps is made of alumina or yttrium aluminum garnet (YAG), electrodes are made of refractory metals, and the end caps are usually made of a ceramic metal composite known as cermet. Alumina and YAG both have coefficients of thermal expansion significantly greater than the refractory metal, such as tungsten or molybdenum, which is typically used as electrode.

There have been some efforts to tailor the coefficient of thermal expansion for end cap materials so as to achieve a coefficient of thermal expansion close to that of the ceramic envelope material. In one example, alumina metal cermets (using tungsten or molybdenum as the metal) have been used as end cap materials. But these cermets have limited flexibility to tailor the coefficient of thermal expansion to those of alumina because, as molybdenum or tungsten is added, the coefficient of thermal expansion of the cermet is reduced with respect to that of alumina or YAG. On the other hand, efforts to reduce the molybdenum volume fraction below 0.5 results in lower electrical conductivity and lower ability to weld metallic components to the cermet.

Therefore, there is a need for a cermet material with acceptable electrical conductivity and a coefficient of thermal expansion equivalent to that of alumina or YAG.

SUMMARY OF THE INVENTION

A first aspect of the present invention provides an electrically conducting cermet comprising at least one transition metal element dispersed in a matrix of at least one refractory oxide selected from the group consisting of yttria, alumina, garnet such as yttrium aluminum garnet or a garnet of comprising a metal of Group 3 or a rare-earth metal and a metal of Group 13, magnesium aluminum oxide, and combinations thereof; wherein an amount of the at least one transition metal element is less than 15 volume percent of the total volume of the cermet.

A second aspect of the invention provides a device comprising an electrically conducting cermet comprising at least one transition metal element dispersed in a matrix of at least one refractory oxide selected from the group consisting of yttria, alumina, garnet, magnesium aluminum oxide, and combinations thereof; wherein an amount of the at least one transition metal element is less than 15 volume percent of the total volume of the cermet.

A third aspect of the invention provides an electric lamp device comprising: a sealed, transparent envelope, wherein the envelope is evacuated or contains one or more chemical elements, chemical compounds, and combinations thereof; at least two electrodes within the envelope; at least two lead wires outside of the envelope corresponding to each electrode, wherein each electrode is connected to the corresponding lead wire through an electrically conducting cermet comprising at least one transition metal element dispersed in a matrix of at least one refractory oxide selected from the group consisting of yttria, alumina, garnet, magnesium aluminum oxide, and combinations thereof; wherein an amount of the at least one transition metal element is less than 15 volume percent of the total volume of the cermet.

A fourth aspect of the present invention provides a method for preparation of an electrically conducting cermet end cap, the method comprising: providing predetermined amounts of powders of at least one transition metal element selected from the group consisting of molybdenum, niobium, tungsten, titanium, zirconium, vanadium, hafnium, tantalum, chromium, iron, cobalt, nickel, combinations thereof, and alloys thereof, and at least one refractory oxide selected from the group consisting of yttria, alumina, garnet, magnesium aluminum oxide, and combinations thereof; wherein an amount of the at least one transition metal element is less than 15 volume percent of the total volume of the cermet, and wherein powders of the transition metal element have a size less than about 105 micrometers; and the powders of the refractory oxide have a size in a range from about 100 micrometers to about 1000 micrometers; mixing together predetermined amounts of powders of at least one transition metal element and at least one refractory oxide to form a blend; compacting the blend to form a desired shape cermet end cap; and sintering the desired shape cermet end cap at a predetermined temperature for a predetermined period of time.

These and other aspects, advantages, and salient features of the present invention will become apparent from the following detailed description, the accompanying drawings, and the appended claims.

DETAILED DESCRIPTION OF THE INVENTION

Figure 1:
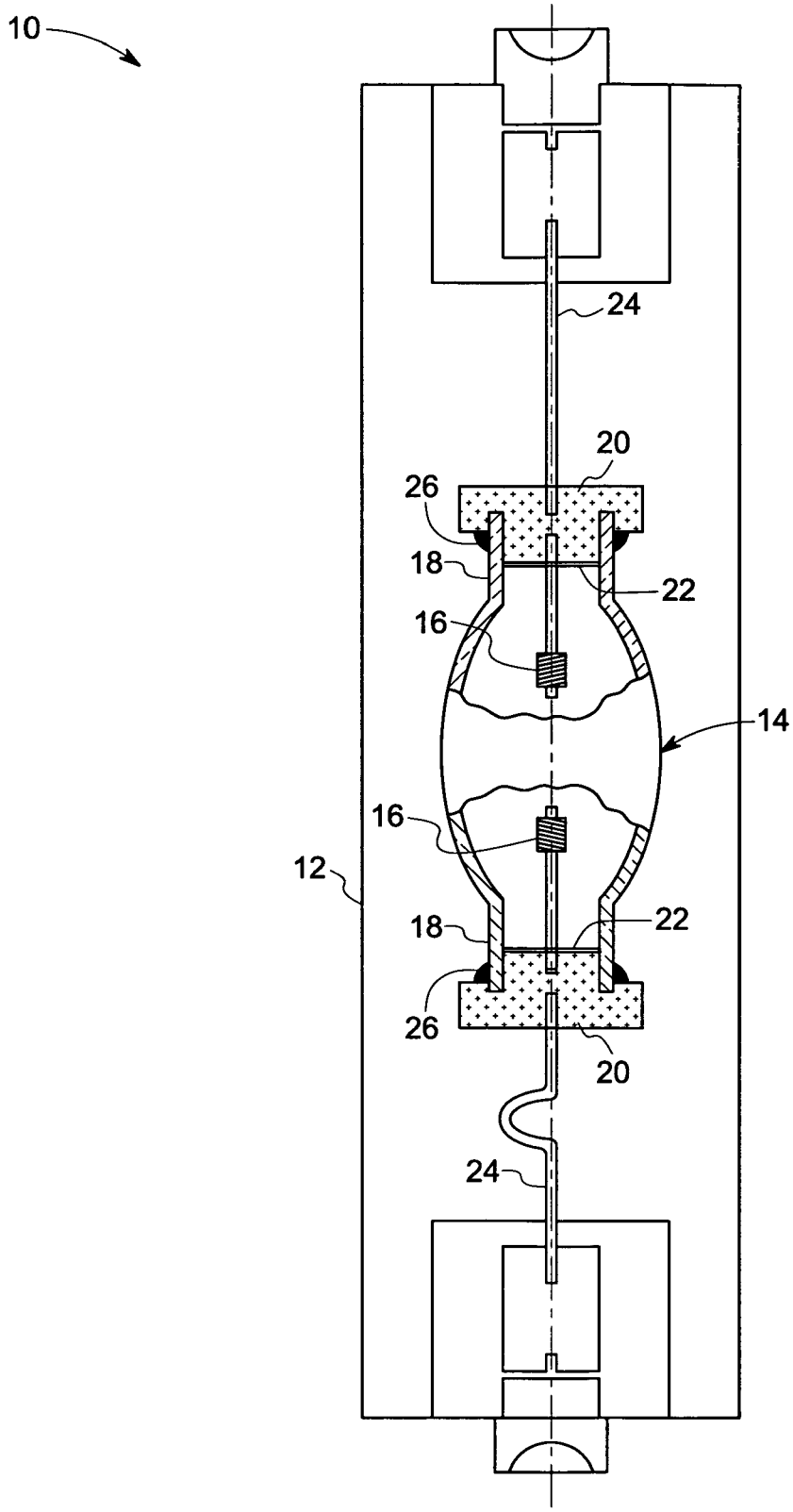
FIG. 1 is a diagrammatic view of an exemplary high intensity discharge lamp.

Referring to the drawings in general, it will be understood that the illustrations are for the purpose of describing different embodiments of the invention, and are not intended to limit the invention thereto.

FIG. 1 is a diagrammatic overview of an exemplary high intensity discharge lamp according to aspects of the present invention. The discharge lamp 10 has an outer cylindrical envelope 12 with ceramic envelope 14 disposed inside. The ceramic envelope 14 is also known as "arc tube". Two metal electrodes 16 are placed inside the ceramic envelope 14 from two end portions 18 of the ceramic envelope 14. End portions 18 of the ceramic envelope 14 are enclosed using a cermet end cap 20 made of a conducting ceramic composite and having an insulating coating 22 of a refractory oxide such as alumina. The insulating coating 22 protects the ceramic composite of the end cap from reacting with plasma and forming an arc. The discharge lamp 10, further comprises a feedthrough conductor 24, which passes through an opening in the cermet end cap 20. Feedthrough conductor 24 is generally made of metals, such as but not limited to, molybdenum, tungsten, and niobium. A ceramic bonding composition 26 is used to seal the end cap 20 to the ceramic envelope 14. The ceramic bonding composition 26 may also be used at the other joints and junctions in the lamp 10, e.g., the ceramic bonding composition 26 may be used to seal the electrode 16, or the feedthrough 24 to the end cap 20.

In one aspect of the present invention, an electrically conducting cermet comprises at least one transition metal element dispersed in at least one refractory oxide selected from the group consisting of yttria, alumina, garnet, magnesium aluminum oxide, and combinations thereof. The garnet is represented by a chemical formula $A_3B_5O_{12}$. Garnet crystal structure has three different types of lattice sites, dodecahedral, octahedral, and tetrahedral, for possible occupation by ions. Further, the number of dodecahedral, octahedral and tetrahedral sites in the garnet crystal structure is 3, 3, and 2, respectively. Dodecahedral sites accepts large ions, such as, yttrium, cerium, praseodymium, neodymium, promethium, samarium, europium, gadolinium, terbium, dysprosium, holmium, erbium, thulium, ytterbium, lutetium, and combinations thereof, whereas, octahedral and tetrahedral sites accept relatively smaller ions such as, aluminum, scandium, iron, chromium, and combinations. Thus, the garnet crystal structure presents numerous possibilities for filling the sites by different ions. The volume percent of the at least one transition metal element is less than 15 volume percent of the total volume of the cermet. In one embodiment, the volume percent of the transition metal element is in a range from about 5 volume percent to about 15 volume percent of the total volume of the cermet. In another embodiment, the volume percent of the transition metal element is in a range from about 5 volume percent to about 10 volume percent of the total volume of the cermet. The transition metal element is selected from the group consisting of molybdenum, niobium, tungsten, titanium, zirconium, vanadium, hafnium, tantalum, chromium, iron, cobalt, nickel, combinations thereof, and alloys thereof. The transition element is well dispersed in the matrix of the refractory oxide and forms a conducting network extending through the grains of the refractory oxide and throughout the cermet.

Figure 2:
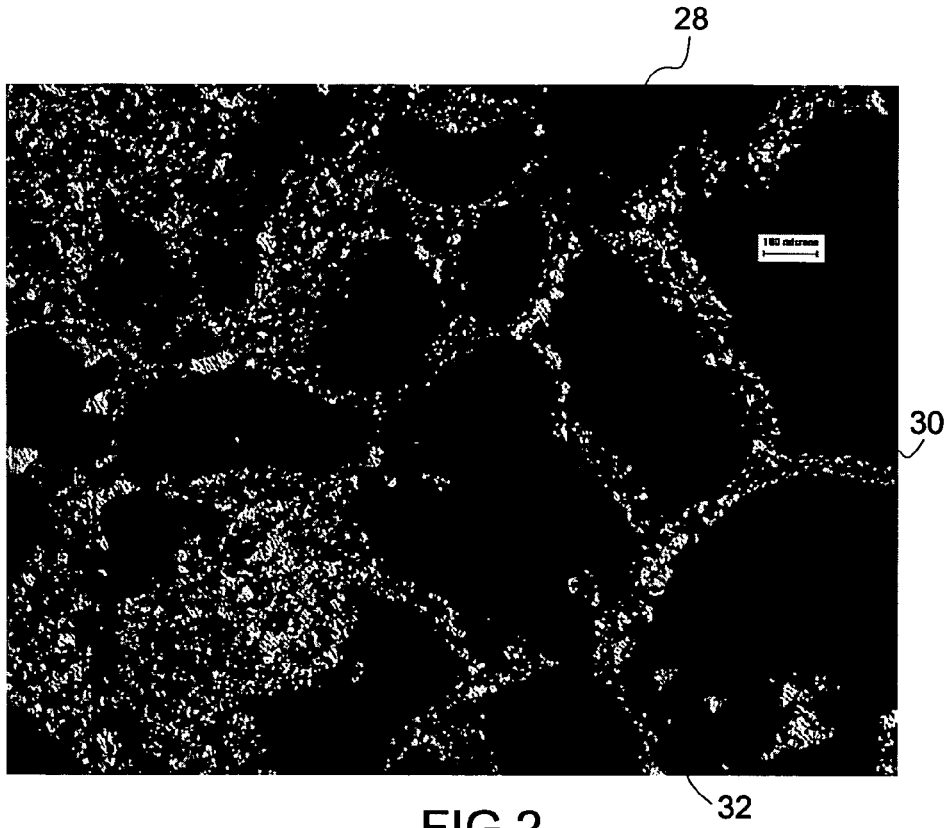
FIG. 2 illustrates a microstructure of an alumina molybdenum cermet.

In one embodiment, the transition metal element is molybdenum, which is dispersed in a matrix of alumina used as the refractory oxide to form an alumina molybdenum cermet. FIG. 2 illustrates a microstructure of alumina molybdenum cermet having about 9 volume percent of molybdenum. Molybdenum forms a conducting network 30 of dispersed molybdenum particles 32 in alumina matrix 28.

In another embodiment, the transition metal element is molybdenum, which is dispersed in a matrix of yttria alumina garnet (YAG) used as the refractory oxide to form a YAG molybdenum cermet.

Figure 3:
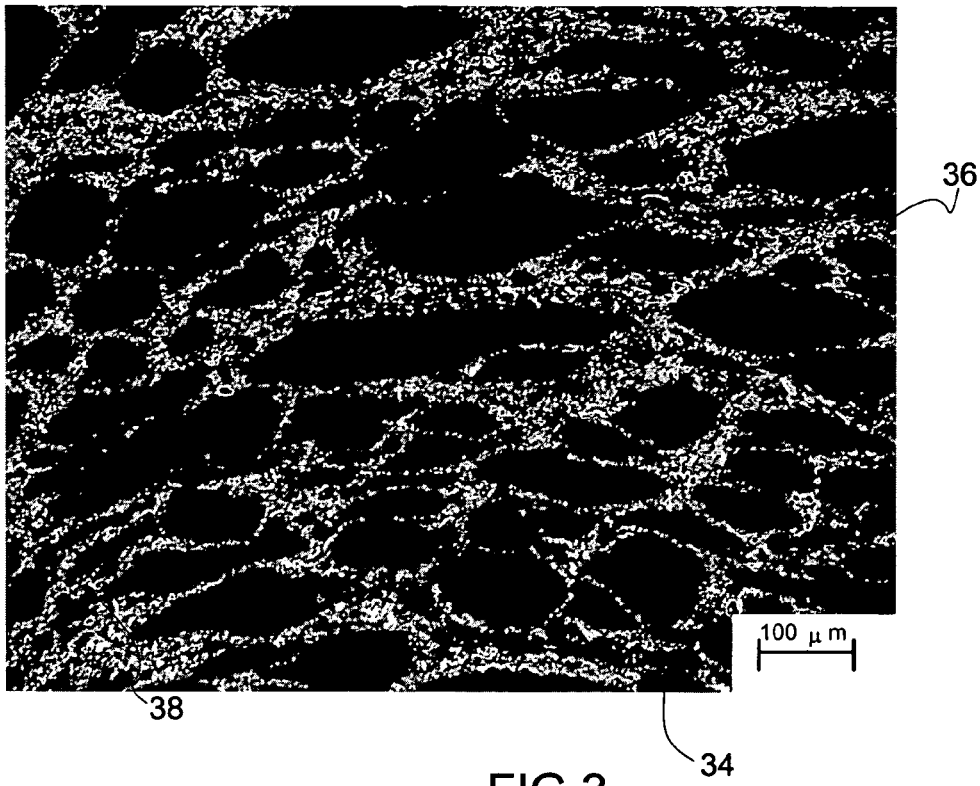
FIG. 3 illustrates a microstructure of a YAG tungsten cermet.

In yet another embodiment, the transition metal element is tungsten, which is dispersed in a matrix of YAG used as the refractory oxide to form a YAG tungsten cermet. FIG. 3 illustrates a microstructure of YAG tungsten cermet having tungsten about 9 volume percent. YAG matrix 34 contains conducting network 36 of tungsten, and voids 38.

In another embodiment, the transition metal element is tungsten, which is dispersed in a matrix of alumina used as the refractory oxide to form an alumina tungsten cermet.

In a second aspect of the present invention, a device comprises an electrically conducting cermet of the present invention. Non-limiting examples of such devices are, ceramic short arc lamp, metal halide lamp, high-pressure sodium discharge lamp, and ceramic automotive lamp. Typically, the ceramic short arc lamp, and ceramic automotive lamp have operating temperatures of about 1200° C. Hence, a YAG tungsten cermet of the present invention, which can sustain high operating temperatures of about 1200° C., is suited for use in these lamps. Ceramic metal halide (CMH) lamps and high-pressure sodium (HPS) lamps that usually have operating temperatures of about 800° C. may employ alumina molybdenum or YAG molybdenum cermets. In one embodiment, the electrically conducting cermet has an electrical resistivity of not more than about $10^{-2}$ Ohm-centimeter.

The cermets of this invention are particularly suited for use in the cermet end cap 20 for ceramic envelope 14 which is usually made of ceramic material such as, but not limited to, quartz, yttrium aluminum garnet, ytterbium aluminum garnet, micro grain polycrystalline alumina, sapphire, polycrystalline alumina, and yttria. The coefficient of thermal expansion of the cermet end cap 20 needs to match the coefficient of thermal expansion of the ceramic materials employed in the ceramic envelope 14. For example, for ceramic envelope 14 made of alumina or YAG, the volume percent of the transition metal element in a cermet comprising YAG or alumina, as the refractory oxide should be kept low, i.e., less than 10 volume percent, so as to reduce mismatch of the coefficient of thermal expansion.

In a third aspect of the present invention, the electrically conducting cermet is used in an electric lamp device in the form of a cermet end cap 20 employed in a sealed, transparent ceramic envelope 14, wherein the ceramic envelope 14 is evacuated or contains one or more chemical elements, chemical compounds, and combinations thereof commonly known as dosing substance. The dosing substance emits a desired spectral energy distribution in response to being excited by the electrical discharge. Dosing substance may comprise a luminous gas, such as rare gas and mercury. The dosing substance may also include a halogen gas (e.g., bromine, iodine, etc.), a rare earth metal halide, and so forth. Further, the electric lamp device 10 comprises at least two electrodes 16 within the ceramic envelope 14, and at least two feedthrough conductor 24 outside of the ceramic envelope 14 corresponding to each electrode 16, wherein each electrode 16 is connected to the corresponding feedthrough conductor 24 through an electrically conducting cermet end cap 20 comprising the electrically conducting cermet of the present invention.

In one embodiment, the electrodes 16 are coupled to the cermet end cap 20. In another embodiment, the electrodes 16 are coupled to the cermet end cap 20 by sintering. In one embodiment, the feedthrough conductors 24 are coupled to the cermet end cap 20. In another embodiment, the feedthrough conductors 24 are coupled to the cermet end cap 20 by sintering. In one embodiment, a reference distance separates the feedthrough conductors 24 and the electrodes 16. In one embodiment, the coefficient of thermal expansion of the cermet end cap 20 is within 6 percent of the coefficient of thermal expansion of at least one of YAG and alumina. In another embodiment, the coefficient of thermal expansion of the end cap 20 is within 3 percent of the coefficient of thermal expansion of at least one of YAG and alumina.

In a fourth aspect of the present invention, a method for preparation of an electrically conducting cermet end cap 20 is provided. The method comprises providing predetermined amounts of powders of at least one transition metal element selected from the group consisting of molybdenum, niobium, tungsten, titanium, zirconium, vanadium, hafnium, tantalum, chromium, iron cobalt, nickel, combinations thereof, and alloys thereof, and at least one refractory oxide selected from the group consisting of yttria, alumina, garnet, magnesium aluminum oxide, and combinations thereof, wherein powders of the transition metal element have a size less than about 105 micrometers; and the powders of the refractory oxide have a size in a range from about 100 micrometers to about 1000 micrometers. Further, the powders of the transition metal element and the refractory oxide are mixed together to form a blend. In general, in case of transition metal element the powder size less than 100 micrometers aids in dispersing the powder in the refractory oxide matrix. In one embodiment, sieving is employed to get powders of the required size. In one embodiment, the mixing comprises milling. Further, milling is done by placing the powders in a container, the container having the powder is then subjected to rolling by placing it on a milling machine.

After mixing, care is taken to minimize exposure of the blend in air or moisture to avoid oxidation or contamination of the blend. In one embodiment, the blend is compacted into a desired shape to form a desired shape cermet end cap using methods such as, but not limited to, pressing, and extrusion. In one embodiment, compaction comprises pressing. In one embodiment, the desired shape cermet end cap 20 is formed by compacting the blend at a predetermined pressure varying in a range from about 100 MPa to about 300 MPa. In a specific embodiment, the blend is pressed at about 275 MPa.

Figure 4:
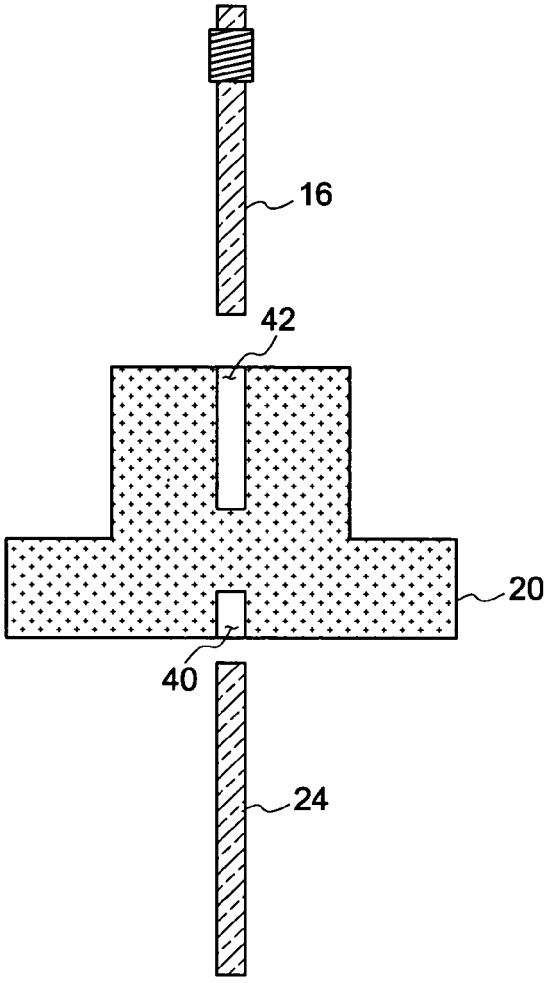
FIG. 4 is a diagrammatic view of an electrode and a feedthrough conductor being coupled to a desired shape cermet end cap.

FIG. 4 is a diagrammatic view of a desired shape cermet end cap 20 being coupled to an electrode 16 and a feedthrough 24. The desired shape cermet end cap 20 has channels 40 and 42 to accommodate the electrode 16 and the feedthrough 24, respectively.

In one embodiment, after compaction, as discussed above, and prior to sintering, the desired shape cermet end cap 20 is prefired at temperatures varying in a range from about 800° C. to about 1250° C. in order to improve the green strength of the prefired end cap. Prefiring aids in handling the prefired end cap 20 and render it less likely to be damaged during processing.

Subsequently, the prefired end cap 20 is sintered at a predetermined temperature. Sintering aids in strengthening and densification of the end cap 20 and coupling the electrode 16 and feedthrough conductor 24 to the cermet end cap. Usually the predetermined temperature is in a range from about 1400° C. to about 2000° C. and predetermined period is in a range from about 1 hour to about 3 hours.

Figure 5:
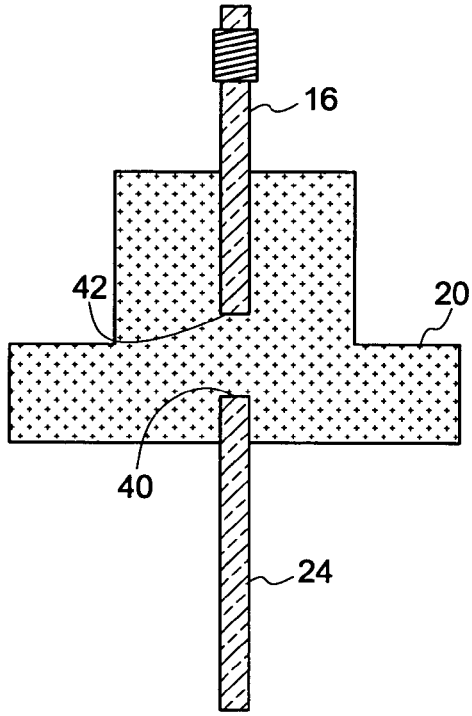
FIG. 5 is a diagrammatic view of a cermet end cap with an electrode and a feedthrough conductor.
Figure 6:
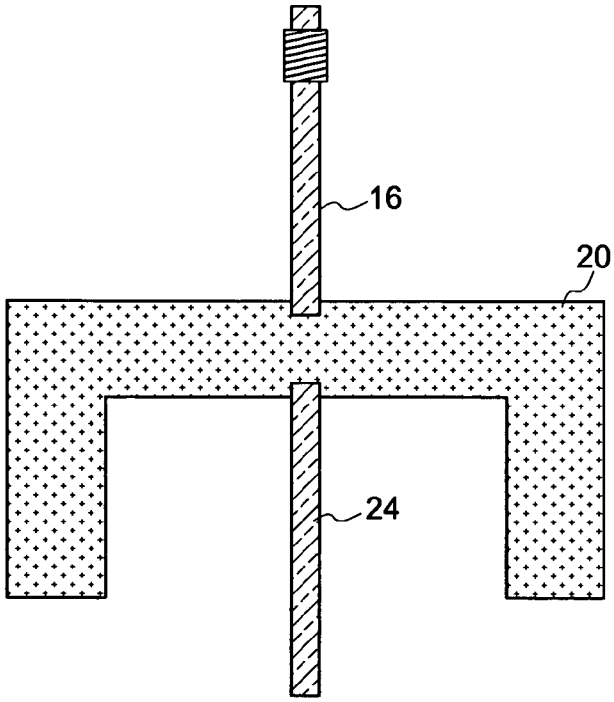
FIG. 6 is an alternate embodiment of FIG. 6, wherein the shape of the cermet end cap differs.
Figure 7:
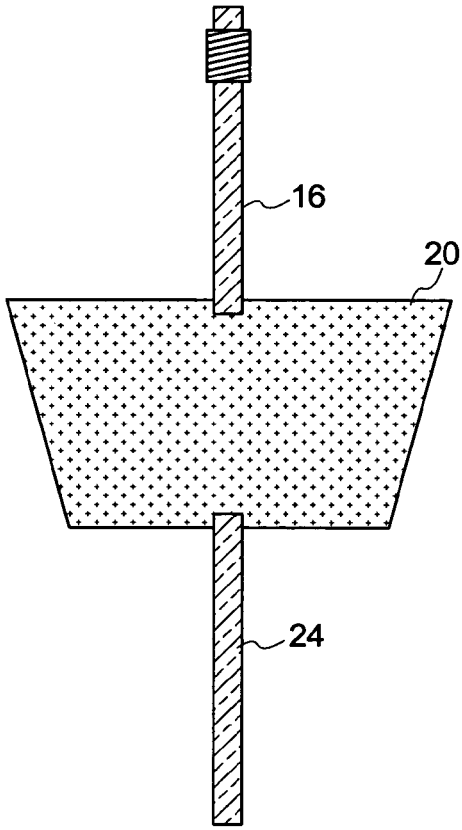
FIG. 7 is an alternate embodiment of FIG. 6, wherein the shape of the cermet end cap differs.

Thereafter the end cap 20 is cooled to ambient temperature to give a cermet end cap 20 having sintered electrode 16 and feedthrough 24. FIG. 5 is a diagrammatic view of a cermet end cap coupled to the electrode 16 and feedthrough conductor 24. The electrode 16 is disposed in the channel 42, likewise, the feedthrough 24 is disposed in the channel 40. The end cap 20 may have different shapes. FIG. 6 and FIG. 7 are diagrammatic view of end cap 20 having different shapes.

The following example illustrates the features of the invention, and is not intended to limit the invention in any way.

EXAMPLE 1

A batch of 45 grams of the alumina molybdenum cermet having 8 volume percent or about 8.91 grams of molybdenum was prepared. An amount of 36.13 grams of alumina powder obtained from Alcoa was used as the refractory oxide material. Molybdenum powder obtained from Alcoa was used as the transition element. Alumina powder was sieved to remove any fines below 105 micrometers size. Calculated amount of alumina powder was then weighed and transferred to plastic bottle, and kept for milling without any grinding media. Milling was done for about 20 minutes. Care was taken to minimize the exposure of the milled alumina powder to air and moisture.

Molybdenum powder was screened through a 105 micrometers mesh, all the large granules were discarded and small particles were selected. An amount of 8.91 grams of molybdenum powder was then weighed. After this, alumina was poured into a glass or stainless steel tray and mixed with molybdenum powder by means of stirring rod, but care was taken to avoid crushing the alumina granules so as to avoid reducing the size of the alumina particles below 100 micrometers in size.

Mixture of alumina and molybdenum powder was then transferred to a plastic bottle and milled for about 20 minutes to form a blend, no grinding media was used for milling.

The blend so formed was then pressed at about 275 MPa using a uniaxial die to form a desired shape cermet end cap. The desired shape cermet end cap was then sintered in dry $H_2$ at 1875° C. for 2 hrs.

While various embodiments are described herein, it will be appreciated from the specification that various combinations of elements, variations, equivalents, or improvements therein may be made by those skilled in the art, and are still within the scope of the invention as defined in the appended claims.

The invention claimed is:

1. An electrically conducting cermet comprising at least one transition metal element dispersed in a matrix comprising a garnet, wherein an amount of the at least one transition metal element is less than 15 volume percent of the total volume of the cermet.

2. The cermet according to claim 1, wherein the transition metal element is selected from the group consisting of molybdenum, niobium, tungsten, titanium, zirconium, vanadium, hafnium, tantalum, chromium, iron, cobalt, nickel, combinations thereof, and alloys thereof.

3. The cermet according to claim 1, wherein the garnet is represented by a chemical formula $A_3B_5O_{12}$, wherein A is a metal selected from the group consisting of yttrium, cerium, praseodymium, neodymium, promethium, samarium, europium, gadolinium, terbium, dysprosium, holmium, erbium, thulium, ytterbium, lutetium, and combinations thereof, and wherein B is at least one of aluminum, scandium, iron, chromium, and combinations thereof.

4. The cermet according to claim 1, wherein the amount of the at least one transition metal element is in a range from about 5 volume percent to about 15 volume percent of the total volume of the cermet.

5. The cermet according to claim 4, wherein the amount of the at least one transition metal element is in a range from about 5 volume percent to about 10 volume percent of the total volume of the cermet.

6. The cermet according to claim 1 which has an electrical resistivity of not more than about $10^{-2}$ Ohm-centimeter.

7. The cermet according to claim 1, wherein the garnet comprises yttrium aluminum garnet.

8. A device comprising an electrically conducting cermet comprising at least one transition metal element dispersed in a matrix comprising a garnet; wherein an amount of the at least one transition metal element is less than 15 volume percent of the total volume of the cermet.

9. The device according to claim 8, wherein the device is a ceramic short arc lamp.

10. The device according to claim 8, wherein the device is a ceramic metal halide lamp.

11. The device according to claim 8, wherein the device is a high-pressure sodium discharge lamp.

12. The device according to claim 8, wherein the device is a ceramic automotive lamp.

13. An electric lamp device comprising:

a sealed, transparent ceramic envelope, wherein the ceramic envelope is evacuated or contains one or more chemical elements, chemical compounds, and combinations thereof;

at least two electrodes within the ceramic envelope; and at least two feedthrough conductors outside of the envelope corresponding to each electrode, wherein each electrode is connected to the corresponding feedthrough conductor through an electrically conducting cermet end cap comprising at least one transition metal element dispersed in a matrix comprising a garnet; wherein an amount of the at least one transition metal element is less than 15 volume percent of the total volume of the cermet.

14. The electric lamp device according to claim 13, wherein the at least two electrodes are coupled to the cermet end cap.

15. The electric lamp device according to claim 14, wherein the at least two electrodes are coupled to the cermet end cap by sintering.

16. The electric lamp device according to claim 13, wherein the at least two feedthrough conductors are coupled to the cermet end cap.

17. The electric lamp device according to claim 16, wherein the at least two feedthrough conductors are coupled to the cermet end cap by sintering.

18. The electric lamp device according to claim 13, wherein the feedthrough conductor and the electrode are connected to the cermet end cap.

19. The electric lamp device according to claim 13, wherein the transition metal element is selected from the group consisting of molybdenum, niobium, tungsten, titanium, zirconium, vanadium, hafnium, tantalum, chromium, iron, cobalt, nickel, combinations thereof, and alloys thereof.

20. The electric lamp device according to claim 13, wherein the garnet is represented by a chemical formula $A_3B_5O_{12}$, wherein A is a metal selected from the group consisting of yttrium, cerium, praseodymium, neodymium, promethium, samarium, europium, gadolinium, terbium, dysprosium, holmium, erbium, thulium, ytterbium, lutetium, and combinations thereof, and wherein B is at least one of aluminum, scandium, iron, chromium, and combinations thereof.

21. The electric lamp device according to claim 13, wherein the amount of the at least one transition metal element is in a range from about 5 volume percent to about 15 volume percent of the total volume of the cermet.

22. The electric lamp device according to claim 21, wherein the amount of the at least one transition metal element is in a range from about 5 volume percent to about 10 volume percent of the total volume of the cermet.

23. The electric lamp device according to claim 13 which has an electrical resistivity of not more than about $10^{-2}$ Ohm-centimeter.

24. The electric lamp device according to claim 13, wherein the garnet comprises yttrium aluminum garnet.

25. The electric lamp device according to claim 13, wherein a coefficient of thermal expansion of the cermet end cap is substantially the same as a coefficient of thermal expansion of the ceramic envelope.

26. The electric lamp device according to claim 25, wherein the coefficient of thermal expansion of the cermet end cap is within 6 percent of the coefficient of thermal expansion of the ceramic envelope.

27. The electric lamp device according to claim 26, wherein the coefficient of thermal expansion of the cermet end cap is within 3 percent of the coefficient of thermal expansion of the ceramic envelope.

* * * * *